US006942741B2

(12) United States Patent
Shimao et al.

(10) Patent No.: US 6,942,741 B2
(45) **Date of Patent: *Sep. 13, 2005**

(54) IRON ALLOY STRIP FOR VOICE COIL MOTOR MAGNETIC CIRCUITS

(75) Inventors: Masanobu Shimao, Takefu (JP); Masaaki Nishino, Takefu (JP); Takehisa Minowa, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 164 days.

This patent is subject to a terminal disclaimer.

(21) Appl. No.: 10/213,099

(22) Filed: Aug. 7, 2002

(65) Prior Publication Data

US 2003/0034091 A1 Feb. 20, 2003

(30) Foreign Application Priority Data

Aug. 7, 2001 (JP) ..... 2001-239334

(51) Int. Cl.[7] ..... H01F 3/00; H01F 3/02; H01F 1/147

(52) U.S. Cl. ..... 148/312; 148/311; 148/306; 720/666; 310/46; 420/87; 420/114; 420/121; 420/122; 420/123; 420/124; 420/125; 420/126; 420/127; 420/128

(58) Field of Search ..... 148/306, 311, 148/312; 420/8, 87, 114, 121, 122, 123–128; 720/666; 310/46

(56) References Cited

U.S. PATENT DOCUMENTS

| | | | | | |
|---|---|---|---|---|---|
| 4,994,122 | A | * | 2/1991 | DeBold et al. | 148/306 |
| 5,091,024 | A | * | 2/1992 | DeBold et al. | 148/306 |
| 5,258,211 | A | | 11/1993 | Momii et al. | |
| 5,298,317 | A | | 3/1994 | Takahashi et al. | |
| 5,501,747 | A | * | 3/1996 | Masteller et al. | 148/311 |
| 6,416,594 | B1 | * | 7/2002 | Yamagami et al. | 148/306 |
| 6,547,889 | B2 | * | 4/2003 | Shimao et al. | 148/311 |

FOREIGN PATENT DOCUMENTS

| | | | |
|---|---|---|---|
| EP | 1 187 131 | A2 | 3/2002 |
| JP | 10-130505 | | 5/1998 |
| JP | 10-212412 | | 8/1998 |
| JP | 11-057812 | A | 3/1999 |
| JP | 11-269617 | A | 10/1999 |
| JP | 11-269617 | * | 10/1999 |
| JP | 2000-096145 | A | 4/2000 |
| JP | 2001-164112 | | 6/2001 |

OTHER PUBLICATIONS

Machine translation of Japanese Patent Publication 11–269617 (cited above).*

* cited by examiner

*Primary Examiner*—John P Sheehan
(74) *Attorney, Agent, or Firm*—Birch, Stewart, Kolasch & Birch, LLP

(57) ABSTRACT

An iron alloy strip having a gage of 0.1 to 5 mm and a magnetic field strength variation within the strip of 0 to 10 Hz, made of an iron alloy consisting essentially of, in % by weight, 0.0001–0.02% of C, 0.0001–5% of Si, 0.001–0.2% of Mn, 0.0001–0.05% of P, 0.0001–0.05% of S, 0.0001–5% of Al, 0.001–0.1% of O, 0.0001–0.03% of N, 0–10% of Co, 0–10% of Cr, 0.01–5% in total of Ti, Zr, Nb, Mo, V, Ni, W, Ta and/or B, and the balance of Fe, and having a saturation magnetic flux density of 1.7–2.3 Tesla, a maximum relative permeability of 1,200–22,000 and a coercive force of 20–380 A/m is suited for use as yokes in voice coil motor magnetic circuits. The iron alloy strip is highly resistant to corrosion and eliminates a need for a corrosion resistant coating.

19 Claims, No Drawings

IRON ALLOY STRIP FOR VOICE COIL MOTOR MAGNETIC CIRCUITS

This application claims priority under 35 U.S.C. §119 of Japanese application no. 2001-239334, filed Aug. 7, 2001, the entire contents of which is hereby incorporated by reference.

BACKGROUND OF THE INVENTION

1. Field of the Invention

This invention relates to iron alloy strips having so high a magnetic flux density and corrosion resistance that they are suited for use as yokes to construct magnetic circuits of voice coil motors in magnetic recording equipment. It also relates to yokes for voice coil motor magnetic circuits.

2. Description of the Related Art

In general, a hard disk unit includes a medium having a magnetic recording film, a spindle motor for rotating the medium at a predetermined rotational speed, a magnetic head for writing and reading information data, a voice coil motor (VCM) for driving the magnetic head, a control device and the like. The voice coil motor has a magnetic circuit which is constructed by a permanent magnet for generating a magnetic flux and yokes combined therewith and used as an actuator for driving the head. In the magnetic circuit for CD and DVD drives, a permanent magnet for generating a magnetic flux and yokes combined therewith are used to construct an actuator for driving a pickup lens. The current drastic competition among manufacturers imposes the requirement of a further cost reduction on voice coil motors.

The first priority for parts used in VCM is cleanness or no dusting. Yokes and other iron parts which are liable to rust are generally used after surface treatment for imparting corrosion resistance because rust releases contaminant particles with which heads and lenses of hard disk and pickup units are contaminated. Additionally, parts themselves are fabricated in a clean manufacture procedure, which inevitably increases the cost of parts. Nevertheless, strict cleanness management is needed to avoid crushes between the magnetic head and the medium and contamination of lenses.

As the yokes in magnetic circuits that constitute voice coil motors, inexpensive customary rolled steel strips of SPCC, SPCD and SPCE are often used to meet the requirement of cost reduction. These customary rolled steel strips are characterized by ease of working such as blanking and bending and a low cost, but fail to inhibit rusting. In a common practice taken in the art to solve the rust problem, after steel strips are worked by a press machine or the like, expensive electroless Ni—P plating is carried out for rust prevention.

To achieve a cost reduction of magnetic circuits, inexpensive materials such as SPCC have been used as described above. Since customary rolled steel strips are unlikely to be corrosion resistant, expensive corrosion resistant metal coatings as by nickel plating must be formed. The inevitable result is a cost increase.

As discussed above, cold rolled steel strips such as SPCC are most often used because of improved productivity as by blanking, shaping, piercing, bending and embossing, and a low cost. However, these steel strips, due to the lack of satisfactory saturation magnetization and corrosion resistance, are difficult to avoid magnetic saturation in partial VCM magnetic circuit when made to a small size and thin wall, failing to fully carry the magnetic flux from a permanent magnet having a high magnetic flux density to the magnetic circuit. The gage of yokes is limited by the restrictions associated with the overall apparatus, which fails to effectively utilize all the magnetic flux of the high performance magnet, leading to partial saturation or magnetic flux leakage midway the magnetic circuit.

The magnetic flux leakage not only reduces the magnetic flux density across the gap of the magnetic circuit, but also has an impact on the adjacent magnetic recording medium and control unit. A certain prescribed limit is imposed on the quantity of magnetic flux leakage from the VCM circuit and the quantity of magnetic flux leakage from products must be below the prescribed value.

Also, to avoid particle contamination such as rust, a surface treatment film must be formed, which makes it quite difficult to reduce the cost.

It would be quite desirable to have a yoke-forming magnetic material which can eliminate the magnetic flux leakage, make full use of a high magnetic flux density inherent to a permanent magnet, and be manufactured at a low cost.

SUMMARY OF THE INVENTION

An object of the invention is to provide an iron alloy strip for use as yokes in VCM magnetic circuits which has a high magnetic flux density and corrosion resistance high enough to omit subsequent formation of a corrosion resistant metal coating, and can be manufactured at a low cost. Another object is to provide a yoke for a VCM magnetic circuit.

The invention provides an iron alloy strip for use as yokes in VCM magnetic circuits, having a gage of 0.1 to 5 mm and a magnetic field strength variation within the strip of 0 to 10 Hz. The strip is made of an iron alloy consisting essentially of, in percents by weight, 0.0001 to 0.02% of C, 0.0001 to 5% of Si, 0.001 to 0.2% of Mn, 0.0001 to 0.05% of P, 0.0001 to 0.05% of S, 0.0001 to 5% of Al, 0.001 to 0.1% of O, 0.0001 to 0.03% of N, 0 to 10% of Co, 0 to 10% of Cr, 0.01 to 5% in total of at least one alloying element selected from among Ti, Zr, Nb, Mo, V, Ni, W, Ta and B, and the balance of Fe and incidental impurities, and having a saturation magnetic flux density of 1.7 to 2.3 Tesla, a maximum relative permeability of 1,200 to 22,000 and a coercive force of 20 to 380 A/m. A yoke comprising the iron alloy strip defined above is also provided for use in VCM magnetic circuits. Since the iron alloy strip has excellent corrosion resistance, the inventive strip eliminates subsequent formation on its surface of a corrosion resistant metal coating, for example, a coating of a metal such as Ni, Cu, Sn, Au, Pt, Zn, Fe, Co or Al or an alloy containing at least 20% by weight of such a metal.

Using the above-described iron alloy strip, a voice coil motor having improved corrosion resistance can be manufactured while maintaining satisfactory characteristics. In particular, cobalt which is less often used because of expensiveness is effective for improving saturation magnetization. Increasing the saturation magnetization of a strip enables to efficiently carry the magnetic flux generated by a high performance permanent magnet to the magnetic circuit. Also, the addition of chromium imparts high corrosion resistance so as to eliminate a need for surface treatment film, leading to a lower cost of manufacture. It is further preferred that the carbide and/or oxide of at least one alloying element selected from among Ti, Zr, Nb, Mo, V, Ni, W, Ta and B as an additive element precipitate in fine dispersion at the grain boundary and/or within the grain of the alloy.

DETAILED DESCRIPTION OF THE INVENTION

Throughout the specification, all percents used in conjunction with alloy components are by weight.

As described in the Summary section, the iron alloy strip suitable for use as yokes in VCM magnetic circuits is made of an iron alloy containing specific amounts of C, Si, Mn, P, S, Al, O and N, preferably specific amounts of Co and Cr, and a specific amount of one or more elements selected from among Ti, Zr, Nb, Mo, V, Ni, W, Ta and B.

Making research on various materials and studying elements capable of improving corrosion resistance thereof under the intention to attain the above objects, the inventors found that steel materials such as SPCC generates scale which accelerates oxidation, when heated in air. The reason is as follow. FeO and $Fe_3O_4$ are metal-poor n-type semiconductors and grow under the impetus of migration of $Fe^{++}$, whereas $Fe_2O_3$ is a metal-rich p-type semiconductor and grows under the impetus of migration of O. Then oxygen penetrates through the oxide layer so that oxidation of iron beneath the oxide layer proceeds. In order to interrupt oxidation, the oxide layer must be dense, crack-free, and adherent enough to prevent oxygen from inward migration. Since Al, Cr and Si are more susceptible to oxidation than Fe and alloy with metals which form stable oxides, they are selectively oxidized prior to Fe to form a thin dense film of $Al_2O_3$, $Cr_2O_3$ and $SiO_2$, respectively, to prevent further progress of oxidation. More specifically, Al and Cr form compound oxides $FeO.Al_2O_3$ and $FeO.Cr_2O_3$, and Si forms a compound oxide $2FeO.SiO_2$. The oxide layer thus formed lacks oxidation resistance if it has a small volume and does not completely cover the underlying surface, and inversely, if it has a large volume, it expands or cracks, losing oxidation resistance as well. Best results are obtained when a dense oxide layer having an appropriate volume completely covers the surface.

The inventors also examined the element that functions to reduce the magnetic flux density among the components of SPCC and similar steel materials. Since C, Al, Si, P, S and Mn have no magnetic moment relative to iron or different magnetic moment from the iron matrix, there arises a phenomenon that the presence of these elements reduces the magnetic moment of nearby iron. In particular, P and S not only reduces the magnetic flux density, but also have negative effects on corrosion resistance. However, reducing the contents of these elements to an extremely low level sacrifices the manufacture cost of starting materials. The performance is satisfactory as long as the inclusion of these elements is limited to a minute amount range.

From these standpoints, the iron alloy strip for use as yokes in VCM magnetic circuits according to the invention contains, in percents by weight, 0.0001 to 0.02% of C, 0.0001 to 5% of Si, 0.001 to 0.2% of Mn, 0.0001 to 0.05% of P, 0.0001 to 0.05% of S, 0.0001 to 5% of Al, and the balance of Fe, and preferably 0.0005 to 0.015%, especially 0.001 to 0.01% of C, 0.0005 to 5%, especially 0.001 to 5% of Si, 0.001 to 0.2%, especially 0.01 to 0.2% of Mn, 0.0001 to 0.05%, especially 0.001 to 0.05% of P, 0.0001 to 0.05%, especially 0.001 to 0.05% of S, 0.0005 to 5%, especially 0.001 to 5% of Al.

Also O and N similarly affect magnetic properties, and the iron alloy preferably contains 0.001 to 0.1% of O and 0.0001 to 0.03% of N. The oxygen and nitrogen contents within these ranges do not significantly degrade the saturation magnetic flux density. Preferably, 0.005 to 0.09%, especially 0.005 to 0.08% of O and 0.0005 to 0.03%, especially 0.0005 to 0.02% of N are contained.

The contents of Co and Cr are each 0 to 10%. In particular, Fe—Cr alloys are known to undergo a linear decline of spontaneous magnetic moment with an increasing chromium content. Larger amounts of Cr added lead to a decline of magnetic flux. Alloys whose composition is 10 to 80% substantially change their physical properties when annealed. When annealed at 475° C., for example, these alloys become mechanically hard and brittle, whereby machining and plastic working (e.g., blanking) capabilities substantially lower and corrosion resistance degrades along with embrittlement. When the alloys are heated at about 700° C. for a long time, σ phase precipitates at the grain boundary, leading to losses of intergranular corrosion resistance and mechanical strength. Therefore, the content of Cr is limited to 10% or less. The content of Cr may be small because the iron alloy strip for a VCM magnetic circuit yoke and the yoke for a VCM magnetic circuit according to the invention are used in an environment which differs from a salt damage environment and a chemical environment both requiring the use of stainless steel. More preferred is 0.02 to 10% of Cr, and especially 4 to 10% of Cr from the corrosion resistance standpoint.

On the other hand, cobalt having a greater number of outer shell electrons than the iron atom serves to increase the magnetic flux density and is important to the present invention. The amount of Co added is 10% at the maximum, and Co within this range increases the saturation magnetic flux density of alloys. With Co contents of more than 10%, the alloys are increased in strength or become too hard to work by rolling, and an economical disadvantage is brought about because cobalt is an expensive metal. A cobalt content of 0.1 to 10%, especially 4 to 10% is preferred. By adding Co in such an amount as to compensate for the addition of an element serving to reduce magnetic flux density, a magnetic flux density comparable to those of prior art SPCC and similar materials can be developed.

At least one element selected from among Ti, Zr, Nb, Mo, V, Ni, W, Ta and B is contained as an additive element. This additive element induces a drop of magnetic flux density when it forms a solid solution with the ferrite phase in the material, but it produces intermetallic compounds with incidentally entrained C, O and N to form carbide, oxide and nitride. As a result, these compounds precipitate finely and uniformly in the alloy structure, precluding migration of dislocations during plastic working. This reduces the excessive ductility of the alloy and suppresses burring at sheared sections during blanking of strips. Alloys containing those elements capable of bounding C, O and N are not sensitized even when quenched from the annealing temperature, have good intergranular corrosion resistance and prevent crystal grains from growing large.

Of the additive elements, Mo, V and Ni are effective for improving the corrosion resistance of iron alloy strips as found in stainless steel. Low carbon alloys become substantially brittle and undergo secondary hardening when tempered at 440 to 540° C., and such temper embrittlement is due to carbide with Cr. The addition of Mo, V and Ni incurs carbon traps by which resistance to temper softening is improved. W, Ta and B are effective for improving the rolling capability of strips, contributing to a reduction of working expense. However, since these elements all serve to reduce saturation magnetization, it is not preferred to add them in a total amount of more than 5%. Therefore, these additive elements are added in a total amount of 0.01 to 5%.

The balance is Fe. Preferably Fe is contained in an amount of at least 50%, especially at least 75% of the iron alloy.

Additionally, the iron alloy strip of the invention should have a saturation magnetic flux density of 1.7 to 2.3 Tesla.

Albeit a high saturation magnetic flux density, if the maximum relative permeability is low or the coercive force is high, the magnetic circuit has an increased magnetic resistance, resulting in a reduced gap magnetic flux density. Therefore, the maximum relative permeability should be in the range of 1,200 to 22,000 and the coercive force is in the range of 20 to 380 A/m. More preferred are a saturation magnetic flux density of 1.8 to 2.3 Tesla, especially 2.0 to 2.3 Tesla, a maximum relative permeability of 1,500 to 22,000, especially 2,000 to 22,000, and a coercive force of 20 to 350 A/m, especially 20 to 300 A/m.

As the yoke material increases its hardness, the force necessary for working such as blanking or bending increases, sometimes beyond the capacity of a press machine. Also an increased burden is imposed on a die so that the die life becomes shorter. It is then preferred that the yoke material have a Rockwell hardness of not more than HRB 90, especially not more than 85.

The alloy components are adjusted to the desired range by selecting suitable raw materials and steel making process. From the productivity and quality standpoints, a continuous casting process is preferred. For the manufacture of a small lot, a vacuum melting process or the like is suited. After casting, hot rolling or cold rolling is implemented in order to produce a steel strip having a desired gage. The iron alloy strip thus obtained is worked into a desired yoke shape by plastic working such as blanking, shaping, piercing, bending or embossing by means of a mechanical press, hydraulic press, fine blanking press or the like. This is followed by deburring, chamfering, mechanical polishing, chemical polishing, electro-polishing or the like, yielding a yoke member having a gage of 0.1 to 5 mm, preferably 0.5 to 4.5 mm and a magnetic field strength variation within the strip of 0 to 10 Hz, preferably 0 to 5 Hz, which is suited for use in VCM.

If the gage of the yoke strip is less than 0.1 mm, it is too thin so that the properties of the magnetic circuit are not significantly improved even when the saturation magnetization of the strip is improved to some extent. Inversely, if the yoke gage is more than 5 mm, it is so thick that a problem of magnetic circuit saturation does not arise even without resorting to the present invention. If the magnetic field strength variation within the yoke strip exceeds 10 Hz, an eddy current flows in proportion to the square of frequency to heat the yoke strip so that oxidation is accelerated, failing to accomplish satisfactory corrosion resistance.

For removal of burrs on yoke members, use may be made of explosive burning, barrel polishing or the like. For finishing, use may be made of mechanical polishing (e.g., buffing), chemical polishing or electro-polishing. Since there are present at the mechanically ground surface a Beilby layer which is an assembly of amorphous ultrafine particles, fragmented crystals resulting from fine division of metal crystals, and a damaged layer of less than several microns comprising plastic deformation regions deformed by working, only mirror-like finishing by buffing will leave the damaged layer behind, failing to achieve the desired performance. Then additional chemical polishing, preferably electro-polishing is necessary. Electro-polishing functions to preferentially dissolve away protrusions on the surface and causes overall dissolution, thereby completely removing the damaged layer. This results in a smooth surface. The electro-polishing is the best treatment for reducing the generation of particles which can break recorded data. For the electro-polishing, an electrolytic solution is prepared by blending perchloric acid, sulfuric acid, hydrochloric acid, nitric acid, acetic acid, phosphoric acid, tartaric acid, citric acid, sodium hydroxide, sodium acetate, soda rhodanide, urea, cobalt nitrate or ferric nitrate with alcohols such as ethanol and propanol, butyl cellosolve, glycerin and pure water.

Since the VCM magnetic circuit yoke manufactured by the above process has improved resistance to corrosion, it is unnecessary to form a corrosion resistant coating on the yoke surface. It is rather undesirable to form a corrosion resistant coating of a metal or alloy on the yoke surface by a suitable technique such as electroplating, electroless plating or ion plating, because the extra coating step adds to the cost of the yoke. That is, the iron alloy strip according to the invention is successful in holding down the manufacture cost of products since a coating of a metal such as Ni, Cu, Sn, Au, Pt, Zn, Fe, Co or Al or a coating of an alloy containing at least 20% by weight of at least one such metal is absent on the surface of the iron alloy strip.

EXAMPLE

Examples of the invention are given below by way of illustration and not by way of limitation.

Examples 1–14

A steel alloy mass having the composition shown as Examples 1–14 in Table 1 was melted and continuously cast, yielding an alloy ingot of 200 mm wide, 500 mm long and 50 mm thick.

The alloy ingot was heated at 1200° C. in an air atmosphere. Hot rolling was started at the temperature, repeated to an accumulated rolling reduction of 60% at 950° C. or lower, and terminated at 850° C. At the end of hot rolling, the strip was air cooled to room temperature. This was followed by cold rolling, finish annealing at 900° C., and acid pickling, yielding a steel strip having a gage of 1 mm.

The steel strip was blanked into yoke shapes by a blanking press machine, obtaining two yoke members for upper and lower yokes. The yoke members thus obtained were subjected to barrel chamfering and electro-polishing. A permanent magnet having a maximum energy product of 400 $kJ/m^3$ was placed inside the upper and lower yokes and adhesively secured at the center of the yokes, constructing a magnetic circuit.

Separately, a piece of about 4 mm square was cut out from the yoke strip prepared above and measured for saturation magnetic flux density by a vibrating sample magnetometer producing a maximum magnetic field of 1.9 MA/m.

From the strip from which the yokes had been blanked out, ring samples having an outer diameter of 45 mm and an inner diameter of 33 mm were prepared. According to the method of JIS C 2531 (1999), two rings were stacked with paper interleaved therebetween. Insulating tape was wrapped around the rings, and a copper wire having a diameter of 0.26 mm was wound around the rings each 50 turns to construct an exciting coil and a magnetization detecting coil, respectively. Using DC magnetization behavior automatic recording instrument having a maximum magnetic field of ±1.6 kA/m, a magnetic hysteresis curve was drawn, from which the maximum relative permeability and coercive force were determined.

To examine the performance of the VCM magnetic circuit fabricated above, the overall magnetic flux quantity across the magnetic circuit gap was measured using a planar coil used in the existing magnetic recording device and a magnetic flux meter (480 Fluxmeter by Lakeshore). Hardness was measured according to JIS Z 2245.

To evaluate corrosion resistance, a strip sample was held for 200 hours in an environment of temperature 80° C. and relative humidity 90%. It was rated ◎ for no rusting, ○ for discoloration and X for rusting.

Comparative Examples 1–6

For comparison purposes, a common SPCC-SD product of 1 mm gage available in the marketplace (Comparative Example 1), and steel strips of 1 mm gage manufactured as in Example 1 from the steel alloy mass having the composition shown as Comparative Examples 2–6 in Table 1 were measured for magnetic properties as in Example 1.

The results are shown in Table 1. In Table 1, the heading "Relative to SPCC" indicates a percent increase or decrease of magnetic flux relative to the magnetic flux quantity of Comparative Example 1.

TABLE 1

| | Alloy composition (wt %) | | | | | | | | | | | | | | | | | | |
|---|---|---|---|---|---|---|---|---|---|---|---|---|---|---|---|---|---|---|---|
| | C | Si | Mn | P | S | Al | O | N | Co | Ni | Cr | Ti | Nb | Zr | Mo | V | Ta | B | Fe |
| Example | | | | | | | | | | | | | | | | | | | |
| 1 | 0.0005 | 0.001 | 0.0032 | 0.003 | 0.003 | 0.0011 | 0.0010 | 0.002 | tr. | tr. | tr. | tr. | tr. | tr. | tr. | tr. | tr. | tr. | bal. |
| 2 | 0.010 | 0.011 | 0.032 | 0.008 | 0.004 | 0.0030 | 0.0008 | 0.001 | tr. | tr. | tr. | 0.05 | tr. | tr. | tr. | tr. | tr. | tr. | bal. |
| 3 | 0.003 | 0.001 | 0.041 | 0.004 | 0.005 | 0.05 | 0.0020 | 0.003 | tr. | tr. | tr. | tr. | tr. | tr. | tr. | tr. | tr. | tr. | bal. |
| 4 | 0.002 | 0.05 | 0.063 | 0.004 | 0.005 | 0.0025 | 0.0011 | 0.002 | tr. | tr. | tr. | tr. | tr. | tr. | tr. | tr. | tr. | tr. | bal. |
| 5 | 0.001 | 0.002 | 0.05 | 0.003 | 0.003 | 0.0018 | 0.0015 | 0.002 | tr. | tr. | tr. | tr. | tr. | tr. | tr. | tr. | tr. | tr. | bal. |
| 6 | 0.005 | 0.001 | 0.045 | 0.003 | 0.004 | 0.0021 | 0.0017 | 0.003 | tr. | tr. | tr. | tr. | tr. | tr. | tr. | 0.05 | tr. | tr. | bal. |
| 7 | 0.003 | 0.003 | 0.053 | 0.003 | 0.003 | 0.0019 | 0.0010 | 0.002 | tr. | tr. | tr. | tr. | tr. | tr. | 0.05 | tr. | tr. | tr. | bal. |
| 8 | 0.003 | 0.005 | 0.070 | 0.004 | 0.008 | 0.0040 | 0.0030 | 0.005 | tr. | tr. | tr. | 5 | tr. | tr. | tr. | tr. | tr. | tr. | bal. |
| 9 | 0.002 | 0.008 | 0.085 | 0.005 | 0.007 | 0.0035 | 0.0035 | 0.006 | tr. | tr. | tr. | tr. | 5 | tr. | tr. | tr. | tr. | tr. | bal. |
| 10 | 0.002 | 0.010 | 0.090 | 0.005 | 0.008 | 0.0038 | 0.0040 | 0.006 | tr. | tr. | tr. | tr. | tr. | 5 | tr. | tr. | tr. | tr. | bal. |
| 11 | 0.002 | 0.012 | 0.052 | 0.006 | 0.008 | 0.0042 | 0.0038 | 0.005 | tr. | tr. | tr. | tr. | tr. | tr. | 5 | tr. | tr. | tr. | bal. |
| 12 | 0.004 | 0.007 | 0.070 | 0.005 | 0.005 | 0.0041 | 0.0050 | 0.005 | tr. | tr. | tr. | tr. | tr. | tr. | tr. | 5 | tr. | tr. | bal. |
| 13 | 0.003 | 0.005 | 0.082 | 0.004 | 0.005 | 0.0032 | 0.0045 | 0.004 | tr. | tr. | tr. | tr. | tr. | tr. | tr. | tr. | 5 | tr. | bal. |
| 14 | 0.003 | 0.011 | 0.074 | 0.006 | 0.006 | 0.0045 | 0.0048 | 0.005 | tr. | tr. | tr. | tr. | tr. | tr. | tr. | tr. | tr. | 5 | bal. |
| Comparative Example | | | | | | | | | | | | | | | | | | | |
| 1 (SPCC) | 0.100 | 0.030 | 0.540 | 0.02 | 0.01 | 0.060 | 0.040 | 0.005 | | | | | tr. | | | | | | bal. |
| 2 (SUS304) | 0.070 | 0.970 | 1.850 | 0.04 | 0.03 | 0.110 | 0.080 | 0.05 | tr. | 10.4 | 18.5 | tr. | tr. | tr. | tr. | tr. | tr. | tr. | bal. |
| 3 (SUS316) | 0.070 | 0.980 | 1.950 | 0.04 | 0.03 | 0.120 | 0.095 | 0.04 | tr. | 13.8 | 17.8 | tr. | tr. | tr. | 2.85 | tr. | tr. | tr. | bal. |
| 4 (SUS410) | 0.140 | 0.920 | 0.910 | 0.038 | 0.028 | 0.040 | 0.092 | 0.05 | tr. | 0.49 | 11.6 | tr. | tr. | tr. | tr. | tr. | tr. | tr. | bal. |
| 5 (SUS416) | 0.130 | 0.930 | 1.220 | 0.052 | 0.16 | 0.050 | 0.085 | 0.04 | tr. | 0.52 | 12.3 | tr. | tr. | tr. | 0.53 | tr. | tr. | tr. | bal. |
| 6 (SUS420J2) | 0.340 | 0.910 | 0.950 | 0.032 | 0.028 | 0.060 | 0.091 | 0.05 | tr. | 0.55 | 12.2 | tr. | tr. | tr. | tr. | tr. | tr. | tr. | bal. |

| | Saturation magnetic flux density (T) | Maximum relative permeability | Coercive force (A/m) | Gap magnetic flux (T) | Relative to SPCC (%) | Rockwell hardness (HRB) | Rusting |
|---|---|---|---|---|---|---|---|
| Example | | | | | | | |
| 1 | 2.178 | 12500 | 60 | 0.601 | 102.0 | 9.3 | ○ |
| 2 | 2.133 | 12350 | 91 | 0.595 | 101.0 | 22.2 | ○ |
| 3 | 2.120 | 11500 | 122 | 0.593 | 100.7 | 10.7 | ○ |
| 4 | 2.115 | 11250 | 140 | 0.593 | 100.7 | 15.1 | ○ |
| 5 | 2.117 | 11050 | 162 | 0.591 | 100.3 | 13.2 | ○ |
| 6 | 2.114 | 12100 | 124 | 0.592 | 100.5 | 9.9 | ○ |
| 7 | 2.114 | 11450 | 135 | 0.592 | 100.5 | 19.1 | ○ |
| 8 | 1.775 | 8500 | 305 | 0.576 | 97.8 | 30.7 | ○ |
| 9 | 1.803 | 7800 | 334 | 0.580 | 98.5 | 21.4 | ○ |
| 10 | 1.795 | 8390 | 350 | 0.579 | 98.3 | 29.5 | ○ |
| 11 | 1.783 | 6750 | 320 | 0.577 | 98.0 | 25.9 | ○ |
| 12 | 1.822 | 7150 | 335 | 0.582 | 98.8 | 17.1 | ○ |
| 13 | 1.798 | 7050 | 315 | 0.580 | 98.5 | 22.1 | ○ |
| 14 | 1.839 | 8250 | 348 | 0.585 | 99.3 | 23.3 | ○ |
| Comparative Example | | | | | | | |
| 1 (SPCC) | 2.080 | 2475 | 420 | 0.589 | 100.0 | 56.9 | X |
| 2 (SUS304) | 0.062 | 4.3 | 470 | 0.235 | 39.9 | 83.9 | ◎ |
| 3 (SUS316) | 0.061 | 4.7 | 661 | 0.232 | 39.4 | 84.8 | ◎ |
| 4 | 1.661 | 606 | 690 | 0.350 | 59.4 | 88.1 | ◎ |

TABLE 1-continued

| | | | | | | | |
|---|---|---|---|---|---|---|---|
| (SUS410) | | | | | | | |
| 5 | 1.602 | 640 | 662 | 0.333 | 56.5 | 91.7 | ⊙ |
| (SUS416) | | | | | | | |
| 6 | 1.648 | 430 | 910 | 0.345 | 58.6 | 94.5 | ⊙ |
| (SUS420J2) | | | | | | | |

Examples 15–30

A steel mass having the composition shown as Examples 15–30 in Table 2 was melted and cast through electric furnace, converter degassing, and continuous casting steps, yielding a slab of 200 mm thick. The molten iron was refined by RH degassing and vacuum oxygen decarburizing (VOD) processes.

The slab of 200 mm thick was heated and soaked at 1100–1200° C. and rolled by a hot roll mill to a thickness of about 10 mm at a finish temperature of 850–950° C. This was followed by annealing at 850–900° C. for recrystallization, pickling, and cold rolling to a thickness of about 4 mm. This was further followed by finish annealing at about 850° C. and pickling, yielding a test steel strip.

The steel strip was blanked into yoke shapes by a blanking press machine, obtaining two yoke members for upper and lower yokes. The yoke members thus obtained were subjected to deburring by explosive burning and chemical polishing. A permanent magnet having a maximum energy product of 400 kJ/m$^3$ was placed inside the upper and lower yokes and adhesively secured at the center of the yokes, constructing a magnetic circuit.

The yoke strip was measured for magnetic properties as in Example 1.

The results are shown in Table 2. In Table 2, the heading "Relative to SPCC" indicates a percent increase or decrease of magnetic flux relative to the magnetic flux quantity of Comparative Example 1.

TABLE

| | Alloy composition (wt %) | | | | | | | | | | | | | | | | | | |
|---|---|---|---|---|---|---|---|---|---|---|---|---|---|---|---|---|---|---|---|
| Example | C | Si | Mn | P | S | Al | O | N | Co | Ni | Cr | Ti | Nb | Zr | Mo | V | Ta | B | Fe |
| 15 | 0.006 | 0.003 | 0.017 | 0.002 | 0.005 | 0.0001 | 0.010 | 0.03 | 0.001 | 0.004 | 4.0 | tr. | tr. | tr. | tr. | tr. | tr. | tr. | bal. |
| 16 | 0.005 | 0.004 | 0.020 | 0.002 | 0.003 | 0.0010 | 0.020 | 0.03 | 0.003 | 0.006 | 6.0 | tr. | tr. | tr. | tr. | tr. | tr. | tr. | bal. |
| 17 | 0.005 | 0.005 | 0.019 | 0.002 | 0.003 | 0.0005 | 0.014 | 0.02 | 0.002 | 0.006 | 8.0 | tr. | tr. | tr. | tr. | tr. | tr. | tr. | bal. |
| 18 | 0.005 | 0.004 | 0.019 | 0.002 | 0.005 | 0.0005 | 0.011 | 0.03 | 0.002 | 0.006 | 10.0 | tr. | tr. | tr. | tr. | tr. | tr. | tr. | bal. |
| 19 | 0.005 | 0.005 | 0.037 | 0.003 | 0.004 | 1.0 | 0.045 | 0.03 | 0.003 | 0.006 | 4.0 | tr. | tr. | tr. | tr. | tr. | tr. | tr. | bal. |
| 20 | 0.005 | 0.005 | 0.036 | 0.003 | 0.005 | 1.0 | 0.052 | 0.02 | 0.003 | 0.006 | 6.0 | tr. | tr. | tr. | tr. | tr. | tr. | tr. | bal. |
| 21 | 0.005 | 0.006 | 0.036 | 0.003 | 0.003 | 1.0 | 0.049 | 0.03 | 0.005 | 0.006 | 8.0 | tr. | tr. | tr. | tr. | tr. | tr. | tr. | bal. |
| 22 | 0.005 | 0.005 | 0.038 | 0.003 | 0.004 | 1.0 | 0.065 | 0.03 | 0.005 | 0.006 | 10.0 | tr. | tr. | tr. | tr. | tr. | tr. | tr. | bal. |
| 23 | 0.005 | 1.0 | 0.021 | 0.002 | 0.003 | 0.0012 | 0.035 | 0.03 | 0.005 | 0.006 | 4.0 | tr. | tr. | tr. | tr. | tr. | tr. | tr. | bal. |
| 24 | 0.005 | 1.0 | 0.037 | 0.003 | 0.003 | 0.0011 | 0.040 | 0.02 | 0.005 | 0.006 | 6.0 | tr. | tr. | tr. | tr. | tr. | tr. | tr. | bal. |
| 25 | 0.012 | 0.004 | 0.045 | 0.004 | 0.003 | 0.0020 | 0.032 | 0.03 | 4.0 | 0.012 | 4.0 | tr. | tr. | tr. | tr. | tr. | tr. | tr. | bal. |
| 26 | 0.034 | 0.005 | 0.053 | 0.004 | 0.005 | 0.0022 | 0.029 | 0.02 | 6.0 | 0.019 | 6.0 | tr. | tr. | tr. | tr. | tr. | tr. | tr. | bal. |
| 27 | 0.012 | 0.005 | 0.063 | 0.003 | 0.005 | 0.0025 | 0.031 | 0.03 | 8.0 | 0.026 | 8.0 | tr. | tr. | tr. | tr. | tr. | tr. | tr. | bal. |
| 28 | 0.005 | 0.007 | 0.018 | 0.002 | 0.005 | 0.0015 | 0.010 | 0.02 | 10.0 | 0.031 | 0 | tr. | tr. | tr. | tr. | tr. | tr. | tr. | bal. |
| 29 | 0.009 | 0.004 | 0.017 | 0.002 | 0.006 | 0.0003 | 0.001 | 0.02 | 10.0 | 0.033 | 4.0 | tr. | tr. | tr. | tr. | tr. | tr. | tr. | bal. |
| 30 | 0.016 | 0.006 | 0.068 | 0.004 | 0.004 | 0.0021 | 0.038 | 0.03 | 10.0 | 0.036 | 10.0 | tr. | tr. | tr. | tr. | tr. | tr. | tr. | bal. |

| Example | Saturation magnetic flux density (T) | Maximum relative permeability | Coercive force (A/m) | Gap magnetic flux (T) | Relative to SPCC (%) | Rockwell hardness (HRB) | Rusting |
|---|---|---|---|---|---|---|---|
| 15 | 2.058 | 7250 | 132 | 0.586 | 99.5 | 27.4 | ⊙ |
| 16 | 1.990 | 6550 | 144 | 0.594 | 100.8 | 42.8 | ⊙ |
| 17 | 1.941 | 5280 | 158 | 0.590 | 100.2 | 46.6 | ⊙ |
| 18 | 1.876 | 3210 | 165 | 0.586 | 99.5 | 51.4 | ⊙ |
| 19 | 1.987 | 7540 | 138 | 0.588 | 99.8 | 46.3 | ⊙ |
| 20 | 1.929 | 6680 | 149 | 0.587 | 99.7 | 49.0 | ⊙ |
| 21 | 1.877 | 5450 | 163 | 0.583 | 99.0 | 50.9 | ⊙ |
| 22 | 1.822 | 3710 | 176 | 0.582 | 98.8 | 56.5 | ⊙ |
| 23 | 2.001 | 9200 | 142 | 0.591 | 100.3 | 62.9 | ⊙ |
| 24 | 1.949 | 8420 | 155 | 0.586 | 99.5 | 67.2 | ⊙ |
| 25 | 2.088 | 3970 | 134 | 0.591 | 100.3 | 42.4 | ⊙ |
| 26 | 2.035 | 3350 | 142 | 0.590 | 100.2 | 62.8 | ⊙ |
| 27 | 2.001 | 3030 | 156 | 0.589 | 100.0 | 71.6 | ⊙ |
| 28 | 2.240 | 2270 | 175 | 0.620 | 105.3 | 52.5 | ○ |
| 29 | 2.225 | 2850 | 156 | 0.605 | 102.7 | 71.3 | ○ |
| 30 | 1.951 | 2220 | 210 | 0.588 | 99.8 | 81.4 | ⊙ |

As seen from Tables 1 and 2, the steel strips having a composition falling within the scope of the invention exhibit an increased relative permeability and a reduced coercive force, as compared with Comparative Examples, and an overall magnetic flux across the magnetic circuit gap comparable to SPCC. No apparent rust was found, indicating the avoidance of particle contamination.

The present invention improves the magnetic properties and corrosion resistance of a yoke member of 0.5–5 mm gage for use as a member to construct a magnetic circuit for VCM in magnetic recording equipment, allowing the magnetic flux produced by the magnet to be effectively conveyed to the magnetic circuit for maintaining a magnetic flux density across the gap. Since the matrix material is improved in corrosion resistance, a magnetic circuit can be constructed at a low cost simply by carrying out chemical polishing or electro-polishing as finishing subsequent to deburring and chamfering and without a need for a corrosion resistant coating.

Japanese Patent Application No. 2001-239334 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A yoke for use in voice coil magnetic circuits formed from an iron alloy strip having a gage of 0.1 to 5 mm and a magnetic field strength variation within the strip of 0 to 10 Hz, the strip being made of an iron alloy consisting essentially of, in percents by weight, 0.0001 to 0.02% of C, 0.0001 to 5% of Si, 0.001 to 0.2% of Mn, 0.0001 to 0.05% of P, 0.0001 to 0.05% of S, 0.0001 to 5% of Al, 0.001 to 0.1% of O, 0.0001 to 0.03% of N, 0.1 to 10% of Co, 0.02 to 10% of Cr, 0.01 to 5% in total of at least one alloying element selected from the group consisting of Ti, Zr, Nb, Mo, V, Ni, W, Ta and B, and the balance of Fe and incidental impurities, and having a saturation magnetic flux density of 1.7 to 2.3 Tesla, a maximum relative permeability of 1,200 to 22,000 and a coercive force of 20 to 380 A/m, and the yoke being free of a corrosion resistant metal coating on its surface.

2. The yoke of claim 1, wherein the strip contains 4 to 10% of Cr.

3. The yoke of claim 1, wherein the strip contains 4 to 10% of Co.

4. The yoke of claim 1, wherein the strip contains 0.005 to 0.09% of O.

5. The yoke of claim 1, wherein the strip contains 0.005 to 0.08% of O.

6. The yoke of claim 1, wherein the strip contains 0.005 to 0.03% of N.

7. The yoke of claim 1, wherein the strip contains 0.005 to 0.02% of N.

8. The yoke of claim 1, wherein the strip contains at least 50% of Fe.

9. The yoke of claim 1, wherein the strip contains at least 75% of Fe.

10. The yoke of claim 1, wherein the strip has a saturation flux density of 1.8 to 2.3 Tesla.

11. The yoke of claim 1, wherein the strip has a saturation flux density of 2.0 to 2.3 Tesla.

12. The yoke of claim 1, wherein the strip has a maximum relative permeability of 1,500 to 22,000.

13. The yoke of claim 1, wherein the strip has a maximum relative permeability of 2,000 to 22,000.

14. The yoke of claim 1, wherein the strip has a coercive force of 20 to 350 A/m.

15. The yoke of claim 1, wherein the strip has a coercive force of 20 to 300 A/m.

16. The yoke of claim 1, wherein the strip has a Rockwell hardness of not more than HRB 90.

17. The yoke of claim 1, wherein the strip has a Rockwell hardness of not more than HRB 85.

18. The yoke of claim 1, wherein the strip has a gage of 0.5 to 4.5 mm.

19. The yoke of claim 1, wherein the strip has a magnetic field variation of 0 to 5 Hz.

* * * * *